US008646151B2

(12) United States Patent
Kopp et al.

(10) Patent No.: US 8,646,151 B2
(45) Date of Patent: Feb. 11, 2014

(54) LIGATURE-RESISTANT VERTICAL GRAB BAR

(76) Inventors: Laurence D. Kopp, Greenlawn, NY (US); Christopher L. Kopp, South Setauket, NY (US)

( * ) Notice: Subject to any disclaimer, the term of this patent is extended or adjusted under 35 U.S.C. 154(b) by 0 days.

(21) Appl. No.: 13/555,602

(22) Filed: Jul. 23, 2012

(65) Prior Publication Data

US 2013/0019434 A1 Jan. 24, 2013

Related U.S. Application Data

(60) Provisional application No. 61/510,692, filed on Jul. 22, 2011.

(51) Int. Cl.
*A47B 95/02* (2006.01)
*E05B 1/00* (2006.01)

(52) U.S. Cl.
USPC ..... 16/110.1; 16/412; 16/436

(58) Field of Classification Search
USPC ..... 16/412, 415, 416, 439, 444; 248/201, 248/200.1, 251, 316.1, 340; 312/348.6
See application file for complete search history.

(56) References Cited

U.S. PATENT DOCUMENTS

| | | | | |
|---|---|---|---|---|
| 1,704,639 | A | 3/1929 | Thompson | |
| 1,914,826 | A | 6/1933 | Ford | |
| 3,156,944 | A | 11/1964 | Bohn | |
| D211,877 | S | 8/1968 | Doman | |
| 3,744,761 | A | 7/1973 | Chervenic et al. | |
| 3,813,071 | A | 5/1974 | Noryd | |
| 3,842,564 | A | 10/1974 | Brown | |
| 3,991,537 | A | 11/1976 | Brown | |
| 4,078,773 | A | 3/1978 | Ellingson, Jr. | |
| 4,351,886 | A * | 9/1982 | Howie, Jr. | 428/591 |
| 4,398,639 | A | 8/1983 | Daniels | |
| 5,050,750 | A | 9/1991 | Mason | |
| 5,165,643 | A | 11/1992 | Shreiner | |
| 5,288,048 | A | 2/1994 | Shreiner | |
| 5,337,525 | A | 8/1994 | Zaccai et al. | |
| 6,113,488 | A * | 9/2000 | Tiede | 454/276 |
| 6,533,251 | B1 | 3/2003 | Abbaticchio | |
| 7,373,694 | B1 | 5/2008 | Kopp | |
| 7,523,592 | B2 | 4/2009 | Horwitz | |
| 7,774,902 | B2 | 8/2010 | Whyzel | |
| 2010/0013248 | A1 * | 1/2010 | Keller | 292/347 |

(Continued)

FOREIGN PATENT DOCUMENTS

JP 2004162401 A * 6/2004

*Primary Examiner* — Chuck Mah
(74) *Attorney, Agent, or Firm* — Galgano & Associates, PLLC; Thomas M. Galgano; Jessica G. Bower

(57) ABSTRACT

A ligature-resistant grab bar for mounting on a surface, having an elongated handgrip having a generally centrally disposed spine extending from the first end of the handgrip to the second end of the handgrip and which is configured and dimensioned to extend outwardly from the surface, when mounted. The spine lying flush against the surface and two arms extending outwardly from the spine along its entire length, each having an outer surface which collectively define the handgrip outer surface. The arms each having an outer free end portion which is configured and dimensioned to be grasped by a user. End caps on each of the ends of the handgrip, at least one of the end caps having an outwardly flared end wall having a first edge joined to the outer surface of the handgrip and a second edge configured and dimensioned to lie flush against the surface.

13 Claims, 4 Drawing Sheets

(56) References Cited

U.S. PATENT DOCUMENTS

2010/0126239 A1* 5/2010 Berger ..... 70/92
2011/0120024 A1* 5/2011 Shilts ..... 49/506
2011/0174026 A1* 7/2011 Salvatore et al. ..... 70/91

* cited by examiner

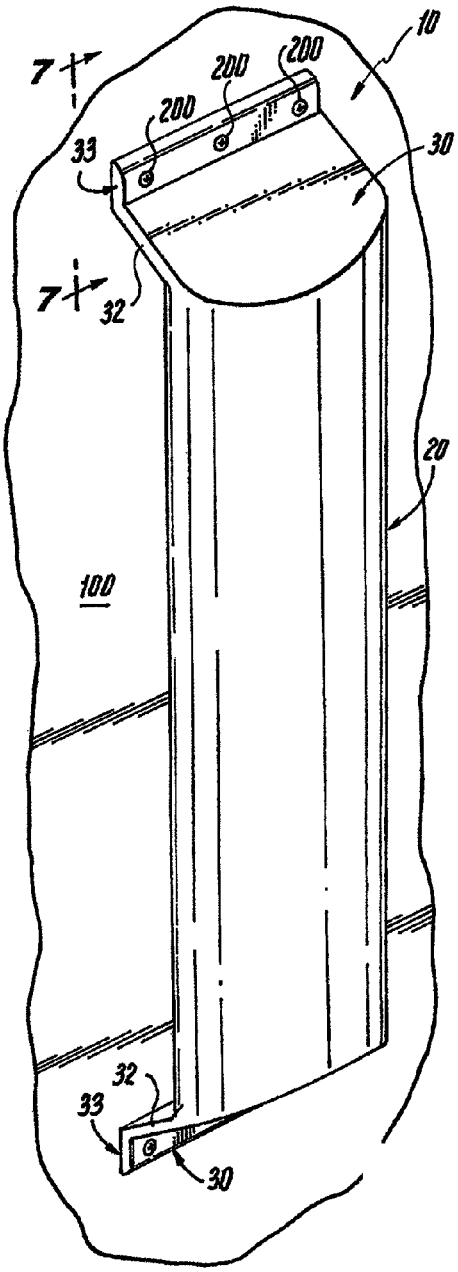
Fig. 1
Fig. 2
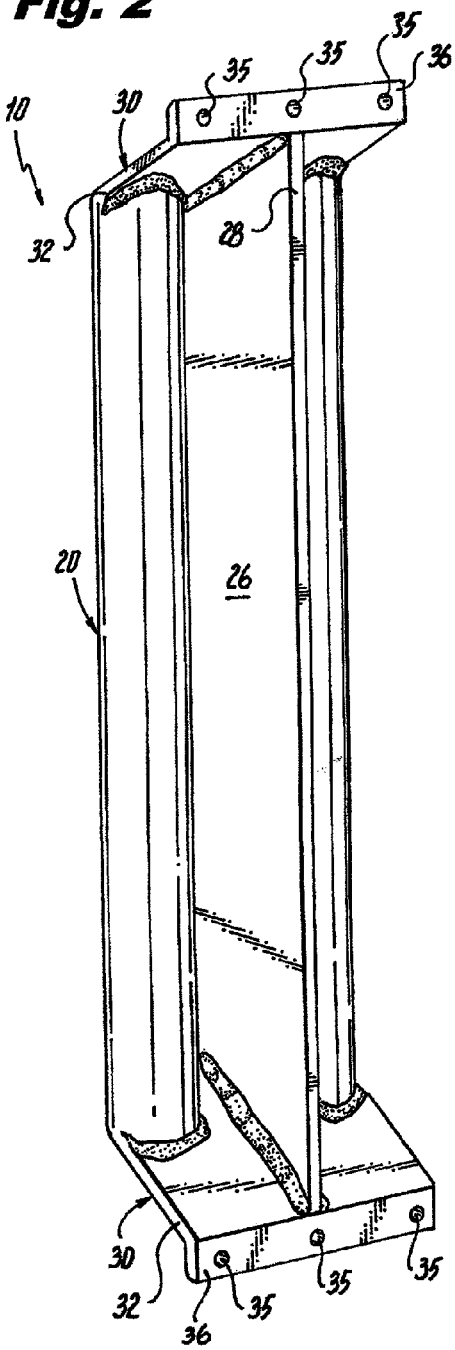

LIGATURE-RESISTANT VERTICAL GRAB BAR

CROSS-REFERENCE TO RELATED APPLICATION

This application claims benefit from U.S. Provisional Patent Application Ser. No. 61/510,692, filed Jul. 22, 2011, the contents of which are hereby incorporated by reference.

BACKGROUND OF THE INVENTION

1. Field of the Invention

The invention is in the field of hand rails and grab bars. More particularly, the present invention is directed to a grab bar which is particularly suitable for mounting in a vertical orientation and for use in institutions, such as, for example, behavioral health and psychiatric facilities or prisons, due to its ligature-resistant structure.

2. Brief Description of the Prior Art

It is known in the art to provide grab bars or hand rails for use in various facilities which a patient can grab on to in order to prevent them from slipping or falling. However, in particular institutional facilities, such as, behavioral health facilities, psychiatric facilities or prisons, it is desirable to install ligature-resistant grab bars, which are resistant to a patient or inmate from placing a tie over the grab bar to hang themselves or cause other self-harm using the grab bar. Therefore, it is desirable to provide grab bars having a structure that is resistant to the risks of suicides and self-harm because a tie which is placed or tied to it would slip off the grab bar and is also prevented from being placed around or behind the grab bar.

It is known to provide for ligature-resistant grab bars, commonly referred to as "security" grab bars, such as that described in the inventor's prior U.S. Pat. No. 7,373,694, the contents of which are hereby incorporated by reference. However, these prior art grab bars should only be installed horizontally. If installed vertically, their chirality (i.e., handedness) becomes an issue. In other words, they are suitable for gripping with either the user's right hand or left hand, but not both. Therefore, a problem arises that when a patient/inmate who may be beginning to fall, grabs for the bar with the wrong hand, the ligature resistant structure of the bar prevents him or her from attaining a grip around the bar. In addition, these grab bars may be ligature-resistant when mounted horizontally, but not if mounted vertically.

Therefore, there is a need for a ligature-resistant grab bar which can be installed vertically on a wall and which can be gripped with either the user's right hand or the left hand, therefore, increasing the patient/inmate's safety. While the prior art discloses many types of handrails and grab bars, so far as is known, none of these grab bars or handrails, resolve these problems in a simple, effective and highly advantageous manner, as in the present invention.

SUMMARY OF THE INVENTION

It is therefore an object of the invention to provide a novel grab bar that is ligature-resistant and minimizes the risks of patient suicides and self-harm.

It is also an object of the invention to provide a grab bar that can be installed in a vertical orientation on a wall.

It is a further object of the invention to provide a grab bar that can be gripped with either the left hand or the right hand.

It is yet another object of the invention to provide a grab bar which resists a tie from being secured thereto.

It is another object of the invention to provide a grab bar which resists a tie from being placed between the grab bar and the surface it is mounted to.

Certain of the foregoing and related objects are readily attained according to the present invention by the provision of a ligature-resistant grab bar for mounting on a surface, comprising an elongated handgrip having first and second opposite ends and an outer surface, wherein said handgrip comprises a generally centrally disposed spine extending from said first end of said handgrip to said second end of said handgrip and which is configured and dimensioned to extend outwardly from the surface, when mounted, said spine having an elongated first edge configured and dimensioned, when mounted, to lie flush against the surface and an opposite second edge; and two arms extending outwardly from said second edge of said spine along its entire length, each having an outer surface which collectively define said handgrip outer surface, said arms each having an outer free end portion which is configured and dimensioned to be grasped by a user; and an end cap on each of said first and second ends of said handgrip, wherein at least one of said end caps has an outwardly flared end wall having a first edge joined to said outer surface of said handgrip and a second edge configured and dimensioned to lie flush against the surface.

In a preferred embodiment, said handgrip has a generally T-shaped cross-section. In another preferred embodiment, said handgrip has a generally Y-shaped cross-section. It is also desirable that said outer free end portions of said arms are generally circular-shaped. Advantageously, said outer surface of said handgrip is generally convex.

It is preferred that both of said end caps have an outwardly flared end wall having a first edge joined to said outer surface of said handgrip and a second edge configured and dimensioned to lie flush against the surface. In addition, in the preferred embodiment, said end caps define screw holes therein for mounting to the surface.

Advantageously, said handgrip is made of extruded aluminum and said end caps are made of cast aluminum. In the preferred embodiment, said handgrip and said end caps collectively have a length in the range of approximately 18 to 36 inches, said handgrip and said end caps have a width of approximately 6 inches, and said handgrip and said end caps have a depth of approximately 4 inches. Desirably, said arms extend outwardly from said second edge of said spine in generally opposite directions.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

FIG. 1 is a front perspective view of the grab bar, according to the present invention, shown mounted on a wall;

FIG. 2 is a rear perspective view of the grab bar;

DETAILED DESCRIPTION OF THE PREFERRED EMBODIMENTS

Figure 7:
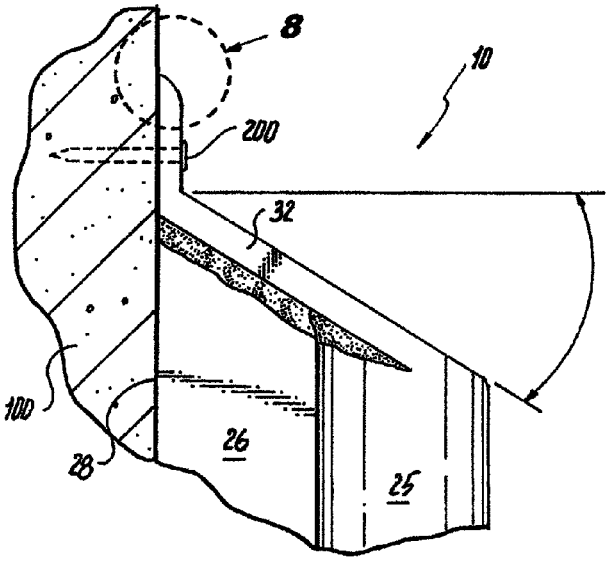
FIG. 7 is an enlarged, sectional view of the top portion of the grab bar shown mounted on a wall, taken along line 7-7 in FIG. 1.
Figure 9:
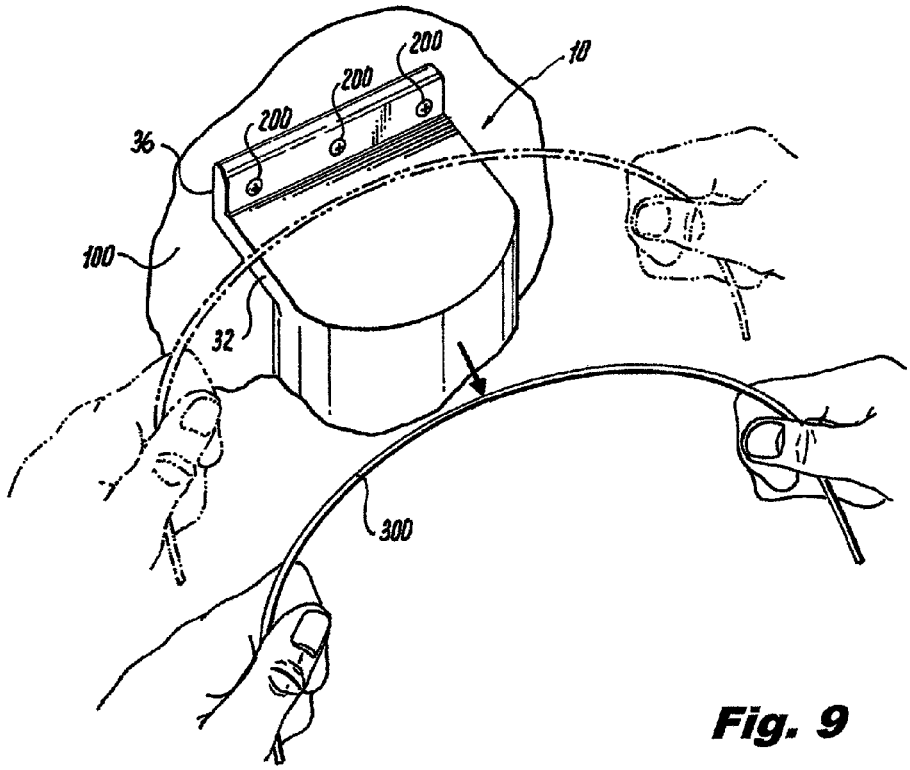
FIG. 9 is a perspective sectional view of the grab bar, mounted on a wall, showing a tie being placed over the grab bar and sliding off the end wall.

Turning now in detail to the drawings, and in particular FIG. 1, therein illustrated is the ligature-resistant grab bar, according to the present invention, generally designated by reference numeral 10. Grab bar 10 is shown mounted on a wall 100 in a vertical orientation. Grab bar 10 allows for a person (not shown) to grab or grasp the grab bar 10 from either side, and with either or both their right hand and/or their left hand. Moreover, grab bar 10 is particularly suitable, when mounted on a wall 100 in a vertical orientation, as shown in FIGS. 1, 7 and 9, for facilities where ligature-resistant structures are desirable, such as prisons, psychiatric facilities or behavioral health facilities. Furthermore, while grab bar 10 is illustrated mounted on a wall 100, it can be appreciated that the grab bar 10 can be mounted in any suitable location, such as, for example, in a bathroom, shower, or on a door.

Turning now to FIGS. 1-2, grab bar 10 comprises a handgrip, generally designated by reference numeral 20, which can be grasped by a user from either side and with either their right and/or left hand. Handgrip 20 extends the entire length between two end caps, each generally designated by reference numeral 30. Particularly, as seen best in FIGS. 4-5, handgrip 20 is elongated and has a first end 22 and an opposite second end 24 and defines an outer surface 21. Handgrip 20 also has a generally centrally disposed spine 26 extending from first end 22 of handgrip 20 to second end 24 of handgrip 20. As seen in FIG. 7, when mounted on a surface, such as wall 100, spine 26 is configured and dimensioned to lie flush against and extend outwardly and perpendicular from wall 100.

Figure 5:
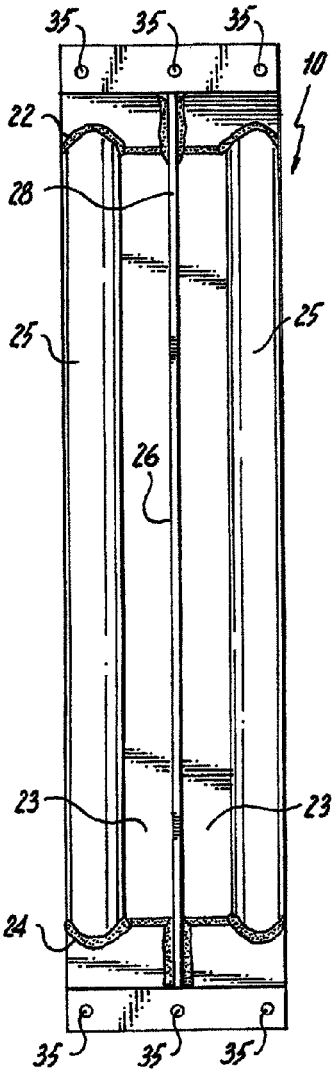
FIG. 5 is a rear elevational view thereof.
Figure 10:
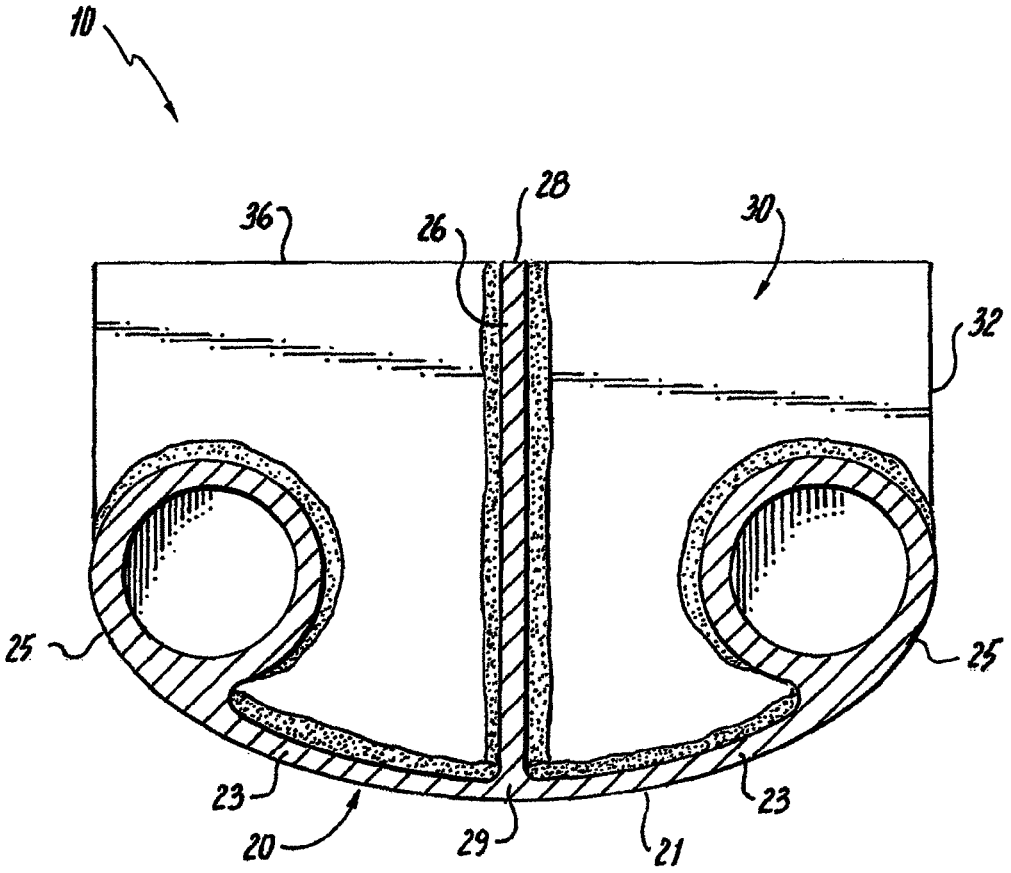
FIG. 10 is a cross-sectional view of the grab bar taken along line 10-10 in FIG. 3.

In particular, as shown in FIGS. 2, 5 and 10 spine 26 has an elongated first edge 28 and an opposite second edge 29. As seen best, in FIG. 7, first edge 28 of spine 26 is configured and dimensioned, when mounted, to lie flush against wall 100, to prevent an object from being placed behind it and, thus, resist a tie from being secured thereto which could be used to cause suicide or other self-harm. Furthermore, when grab bar 10 is mounted on wall 100, pick-resistant caulk (not shown) may be used to fill any gaps between the wall 100 and the first edge 28 of spine 26. This may be necessary to correct for gaps created by irregularities in the wall 100, in order to prevent a tie from being placed behind the handgrip 20. PECORA DYNAPDXY EP-1200 manufactured by Pecora Corporation of Harleysville, Pa., or other pick proof sealants should be suitable for this purpose.

Figure 6:
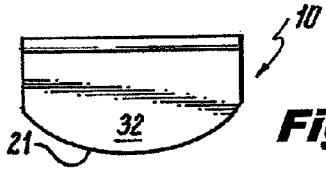
FIG. 6 is a top plan view thereof, the bottom plan view being a mirror image thereof.

As seen best in FIGS. 5 and 10, handgrip 20 also includes two arms 23 which extend outwardly from second edge 29 of spine 26 along its entire length. Both of arms 23 provide the structural integrity to support the grip portions 25 of the grab bar 10. Furthermore, as seen in FIGS. 1 and 10, each of arms 23 have an outer surface which collectively define the outer surface 21 of handgrip 20. In a preferred embodiment, outer surface 21 of handgrip 20 is generally convex, as seen best in FIGS. 6 and 10 and has no sharp edges which may be used to cause self harm.

Additionally, as seen best in FIGS. 5 and 10, arms 23 each have an outer free end portion 25 which is configured and dimensioned to be grasped by a user (not shown). Preferably, outer free end portions 25 of arms 23 are generally circular-shaped, as shown in FIG. 10, to aid the user in gripping handgrip 20. Advantageously, arms 23 extend outwardly from second edge 29 of spine 26 in generally opposite directions, to allow grab bar 10 to be grasped from either side, as illustrated in FIG. 10. The angle between arms 23 can be altered to move the free end portions 25 closer together or farther apart depending on the particular needs. In a preferred embodiment, handgrip 20 has a generally T-shaped cross-section, as shown in FIG. 10. In another embodiment, handgrip 20 has a generally Y-shaped cross-section (not shown). However, other suitable configurations of arms 23 are possible.

Figure 4:
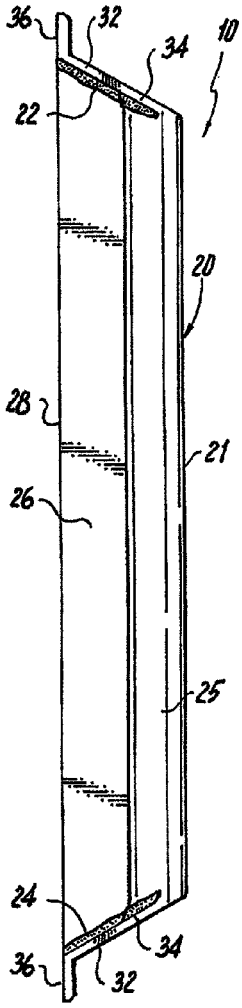
FIG. 4 is a left side elevational view thereof, the right side being a mirror image thereof.

In addition, as seen in FIGS. 2, 4 and 5, grab bar 10 includes end caps 30 on each of first end 22 and second end 24 of handgrip 20. End caps 30 completely cover first end 22 and second end 24 of handgrip 20, to prevent an object or tie from being secured to handgrip 20, to resist suicides. End cap 30, which is disposed on the top of grab bar 10 when mounted in a vertical orientation, as in FIG. 1, has an outwardly flared end wall 32, but preferably, both end caps have an outwardly flared end wall 32. Each of end walls 32 have an end 34, each of which are joined to top end 22 and bottom end 24 of handgrip 20, as seen in FIG. 4. End wall 32 also has a second edge 36 which is configured and dimensioned to lie flush against wall 100. The downwardly sloped configuration of end wall 32, when grab bar 10 is mounted in a vertical direction, as seen in FIG. 9, prevents a tie 300 from being secured thereto which could be used to cause suicide or other self-harm, since tie 300 would slip downwardly and off end wall 32. Moreover, since second edge 36 is disposed against wall 100, as in FIG. 7, a tie is resisted from being placed behind it.

Preferably, both of end caps 30 have an outwardly flared end wall 32, each having a first edge 34 joined to top end 22 of handgrip 20 and a second edge 36 configured and dimensioned to lie flush against wall 100, to allow the grab bar 10 to maintain its ligature-resistant properties when mounted vertically, in either direction. As seen in FIGS. 2 and 4, end caps 30 cover the entire handgrip 20 to prevent a tie from being secured over handgrip 20. Preferably, end caps 30 are welded to the entire ends 22 and 24 of hand grip 20 and any rough edges are smoothed, as seen in FIG. 10. Furthermore, it is desirable that outer surface 21 of handgrip 20 and end caps 30 collectively form a smooth outer surface, as seen in FIG. 4 to prevent an object or tie from being secured thereto.

Figure 3:
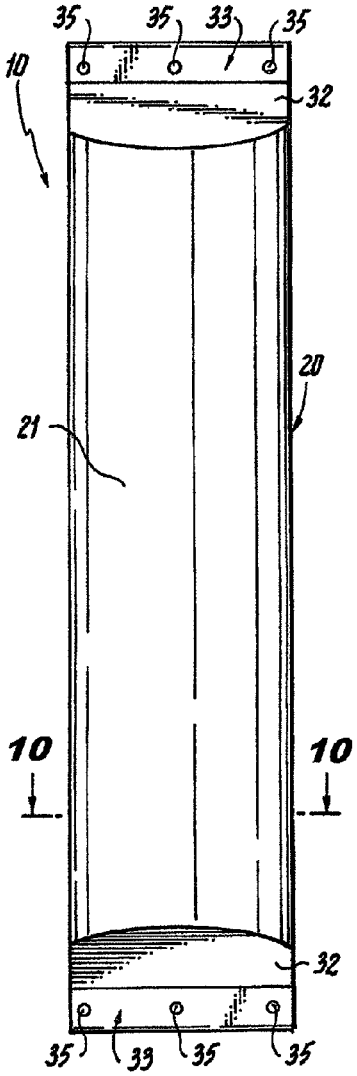
FIG. 3 is a front elevational view thereof.

In the preferred embodiment, end caps 30 also comprise means for mounting grab bar 10 to the wall 100. Preferably, as seen in FIGS. 2, 3 and 5 end caps 30 define a plurality of screw holes 35 therein so that grab bar 10 can be mounted to wall 100 with corresponding fasteners 200 (see, FIG. 7). Where ligature-resistant properties are desired, fasteners 200 can be tamper-proof screws, such as the tamper-resistant fasteners made by Tamperproof Screw Co., Inc. of Hicksville, N.Y. Tamper-resistant fasteners 200 are resistant to removal by a patient/inmate, however, allow for removal by authorized persons, such as, for example, maintenance personnel, through use of a tool specifically adapted to remove tamper-resistant fasteners and are to be specified by the end user depending on the nature of the behavioral environment.

Figure 8:
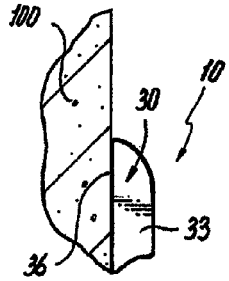
FIG. 8 is an enlarged view of section 8 in FIG. 7.

Particularly, as seen in FIG. 3, end caps 30 include a flange 33 disposed around one or more of the sides thereof which has screw holes 35 located therein, which are used to mount the grab bar to the wall. Preferably, flange 33 has a rounded upper edge, as shown in FIG. 8, to resist a tie from being affixed thereto. It is preferable in order to provide sufficient strength, that a minimum of four (4) screw holes 35 are provided on each end cap 30. The locations of the screw holes are shown for illustrative purposes only and it can be appreciated that the means for mounting and the location of the screw holes can be varied, and can be in other locations on grab bar 10, such as a flange extending outwardly from spine 26 (not shown).

Thus, in use, as shown in FIGS. 1, 7 and 9, grab bar 10 is mounted in a vertical orientation on wall 100, with spine 26 and edges 36 of each of end caps 30 disposed flush against wall 100. The downwardly sloped end wall 32 on the upper end cap 30 resists a tie from being affixed thereto which could be used to cause suicide or self-harm. Furthermore, since the grab bar 10 is disposed flush against wall 100, it resists a tie from being placed behind it. In addition, when mounted, a user can grasp either or both of end portions 25 of arms 23 and with either their right hand or left hand.

Handgrip 20 is preferably made from extruded aluminum with cast aluminum end caps 30. However, it can be appreciated that other suitable materials can be utilized. It is also preferable that handgrip 20 and end caps 30 collectively have a length in the range of approximately 18 to 36 inches, a width of approximately 6 inches, and a depth of approximately 4 inches. However other suitable sizes and dimensions can be utilized, according to the particular needs.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention. Moreover, although the grab bar according to the present invention is particularly suitable for institutional facilities due to its ligature resistant features, it can be utilized in any other location where such grab bars are desirable.

What is claimed is:

1. A ligature-resistant grab bar for mounting on a supporting surface, comprising:

an elongated handgrip having first and second opposite ends and an outer surface, wherein said handgrip comprises a generally centrally disposed spine extending from said first end of said handgrip to said second end of said handgrip and which is configured and dimensioned to extend outwardly from the supporting surface, when mounted, said spine having an elongated first edge configured and dimensioned, when mounted, to lie flush against the supporting surface and an opposite second edge; and two arms extending outwardly from said second edge of said spine along its entire length, each having an outer surface which collectively define said handgrip outer surface, said arms each having an outer free end portion which is generally arcuate-shaped and having at least a portion which curves inwardly towards said spine and is configured and dimensioned to be grasped by a user; and two end caps respectively disposed on said first and second ends of said handgrip, wherein at least one of said end caps has an outwardly flared end wall having a first edge joined to said outer surface of said handgrip and a second edge configured and dimensioned to lie flush against the supporting surface.

2. The grab bar according to claim 1, wherein:

said handgrip has a generally T-shaped cross-section.

3. The grab bar according to claim 1, wherein:

said handgrip has a generally Y-shaped cross-section.

4. The grab bar according to claim 1, wherein:

said outer free end portions of said arms are generally circular-shaped.

5. The grab bar according to claim 1, wherein:

said outer surface of said handgrip is generally convex.

6. The grab bar according to claim 1, wherein:

the other one of said end caps has an outwardly flared end wall having a first edge joined to said outer surface of said handgrip and a second edge configured and dimensioned to lie flush against the supporting surface.

7. The grab bar according to claim 1, wherein:

said end caps define screw holes therein for mounting to the supporting surface.

8. The grab bar according to claim 1, wherein:

said handgrip is made of extruded aluminum.

9. The grab bar according to claim 1, wherein:

said end caps are made of cast aluminum.

10. The grab bar according to claim 1, wherein:

said handgrip and said end caps collectively have a length in the range of approximately 18 to 36 inches.

11. The grab bar according to claim 1, wherein:

said handgrip and said end caps have a width of approximately 6 inches.

12. The grab bar according to claim 1, wherein:

said handgrip and said end caps have a depth of approximately 4 inches.

13. The grab bar according to claim 1, wherein:

said arms extend outwardly from said second edge of said spine in generally opposite directions.

* * * * *